United States Patent [19]

Su

[11] Patent Number: 5,020,836

[45] Date of Patent: Jun. 4, 1991

[54] EASILY OPENABLE TUBULAR LATCH

[76] Inventor: Frank Su, c/o Hung Hsing Patent Service Center, P.O. Box 55-1670, Taipei, Taiwan

[21] Appl. No.: 619,009

[22] Filed: Nov. 28, 1990

[51] Int. Cl.[5] ..... E05C 1/16

[52] U.S. Cl. ..... 292/165

[58] Field of Search ..... 292/165, 166, 167, 169 R, 292/191, 192

[56] References Cited

U.S. PATENT DOCUMENTS

| | | | |
|---|---|---|---|
| 2,222,411 | 11/1940 | Kaiser | 292/165 |
| 2,322,040 | 6/1943 | Maruri | 292/166 X |
| 3,141,320 | 7/1964 | McConnell | 292/165 X |

*Primary Examiner*—Richard E. Moore

[57] ABSTRACT

A tubular latch includes: a biasing lever pivotally mounted on a housing of the latch having an upper depression portion operatively pulled by a drag slide biased by a cam of a handle driving shaft, and having a lower forcing portion of the biasing lever operatively pulling a latch for opening the door, whereby upon a depression of a handle secured to the handle driving shaft at a small angle to pull the drag slide rearwardly to bias the upper depression portion of the lever about a lever pivot with a small stroke, the lower forcing portion below the upper depression portion will be biased with a greater stroke for fully retracting the latch for easily opening the door, without requiring a great rotating angle for depressing the handle.

5 Claims, 3 Drawing Sheets

EASILY OPENABLE TUBULAR LATCH

BACKGROUND OF THE INVENTION

A conventional tubular latch as shown in FIG. 8 includes a latch L resiliently held in a housing S fixed in a tubular hole formed in a door R and operatively retracted for opening the door by biasing a door handle H (direction R1) whereby a cam C as rotated (in direction R2) by the handle H will pull a driving plate D secured with the latch L to retract the latch L in rearward direction R3 for opening the door.

For biasing the handle H for opening the door, it will require a greater rotating angle A (such as 70 degrees) since a stroke L2 for retracting the latch L in direction R3 for opening the door equals to an arc length of the rotated cam C of the handle H and the retraction of the latch L should be directly actuated by rotating the cam C and handle H, thereby causing an inconvenient door opening operation by baising the handle with a greater rotating angle, especially inconvenient for the door opening by a passer-by whose two hands carrying a heavy goods or by a diabled person.

SUMMARY OF THE INVENTION

The object of the present invention is to provide a tubular latch including a biasing lever pivotally mounted on a housing of the latch having an upper depression portion operatively pulled by a drag slide biased by a cam of a handle driving shaft, and having a lower forcing portion of the biasing lever operatively pulling a latch for opening the door, whereby upon a depression of a handle secured to the handle driving shaft at a small angle to pull the drag slide rearwardly to bias the upper depression portion of the lever about a lever pivot with a small stroke, the lower forcing portion below the upper depression portion will be biased with a greater stroke for fully retracting the latch for easily opening the door, without requiring a great rotating angle for depressing the handle.

DETAILED DESCRIPTION

Figure 1:
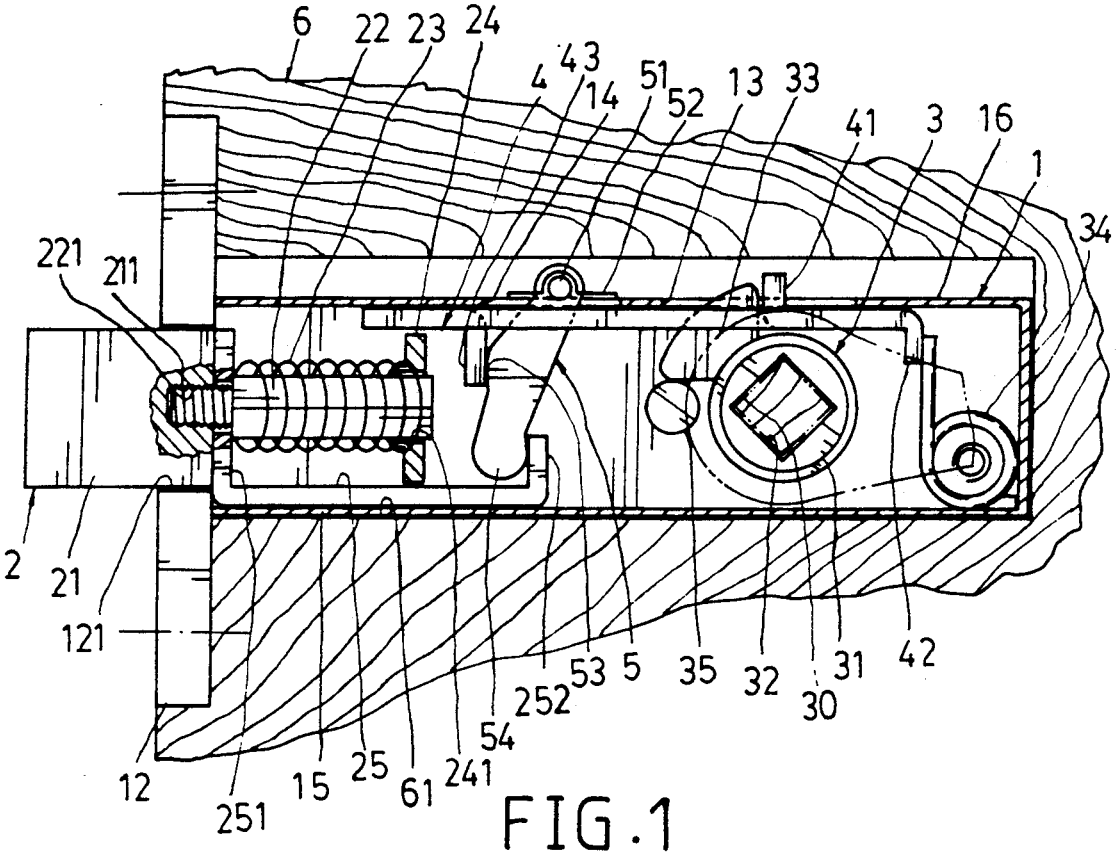
FIG. 1 is an elevational drawing of the present invention.
Figure 2:
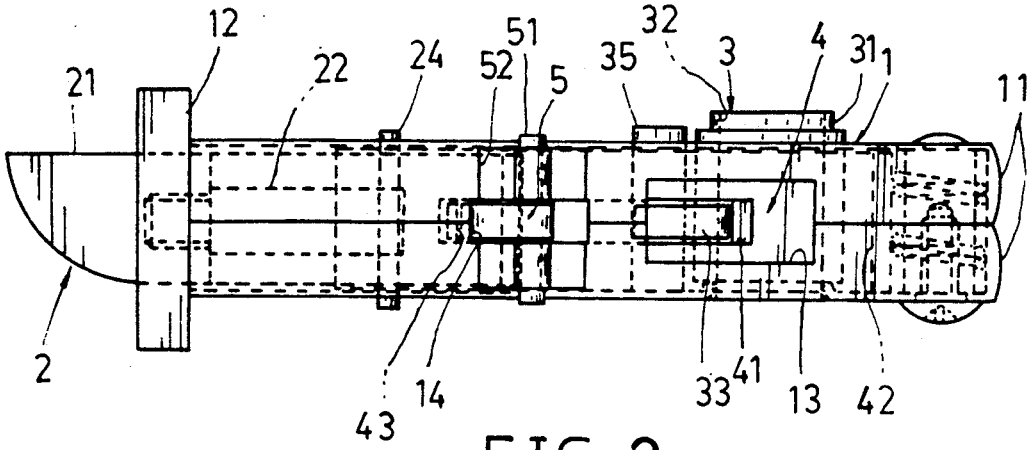
FIG. 2 is a top view drawing of the present invention.
Figure 3:
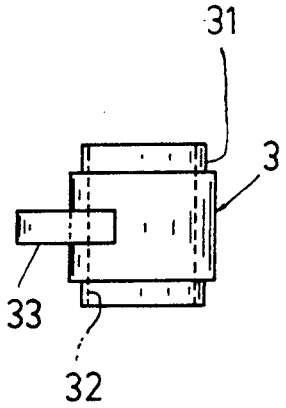
FIG. 3 shows a handle driving means of the present invention.
Figure 4:
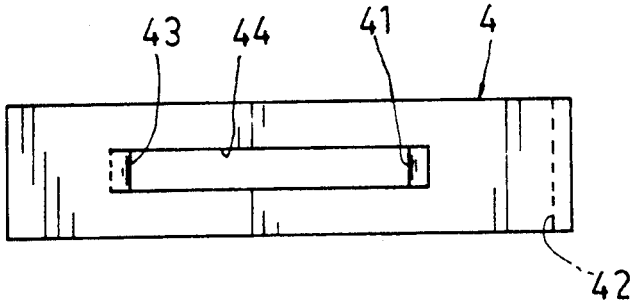
FIG. 4. shows a drag slide of the present invention.
Figure 5:
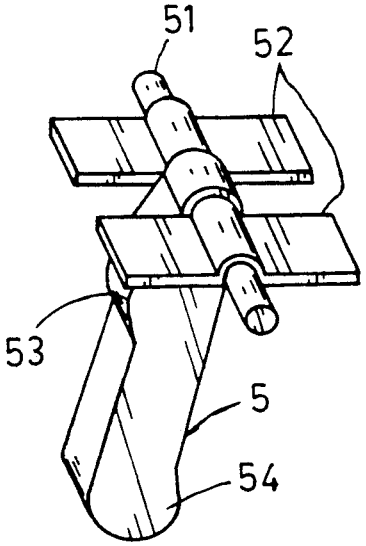
FIG. 5 shows a biasing lever of the present invention.

As shown in FIGS. 1-6, the present invention fixed on a door 6 comprises: a housing 1, a latch means 2 formed on a front portion of the housing 1, a handle driving means 3 formed on a rear portion of the housing 1, a drag slide 4, and a biasing lever 5 positioned between the latch means 2 and the handle driving means 3.

The housing 1 includes: two half covers 11 combinable for integrating the housing 1 for fixing the elements of the present invention therein, a front fixing plate 12 formed on a front portion of the housing 1 for mounting the present invention on the door 6 by screws (not shown), a rear slot 13 formed in an upper rear portion of the housing 1, and a front slot 14 formed in an upper front poriton of the housing 1. The housing 1 is fixed in the tubular hole 61 drilled in a door 6.

The latch means 2 includes: a latch member 21 reciprocatively held in the housing 1 through a latch hole 121 formed in the fixing plate 12, a latch bolt 22 having a male-threaded portion 221 engageable with a female-threaded hole 211 formed in the latch member 21 for securing the latch member 21 with the bolt 22, a latch restoring spring 23 disposed around the bolt 22 for urging the latch member 21 outwardly (frontwardly) and retained on a retainer plate 24 secured to the housing 1 (of which a central hole 241 is formed for reciprocating the bolt 22 therein when retracting the latch 21 and bolt 22), and a follower plate 25 having a front bending portion 251 secured between the latch member 21 and the latch bolt 22 and a rear bending portion 252 bending upwardly to be biased by the lower forcing portion 54 of the lever 5. The follower plate 25 is slidably formed on a lower portion of the housing 1 to be slidably guided between the retainer plate 24 and a bottom plate 15 of the housing 1 for a stable sliding operation of the follower plate 25.

Figure 6:
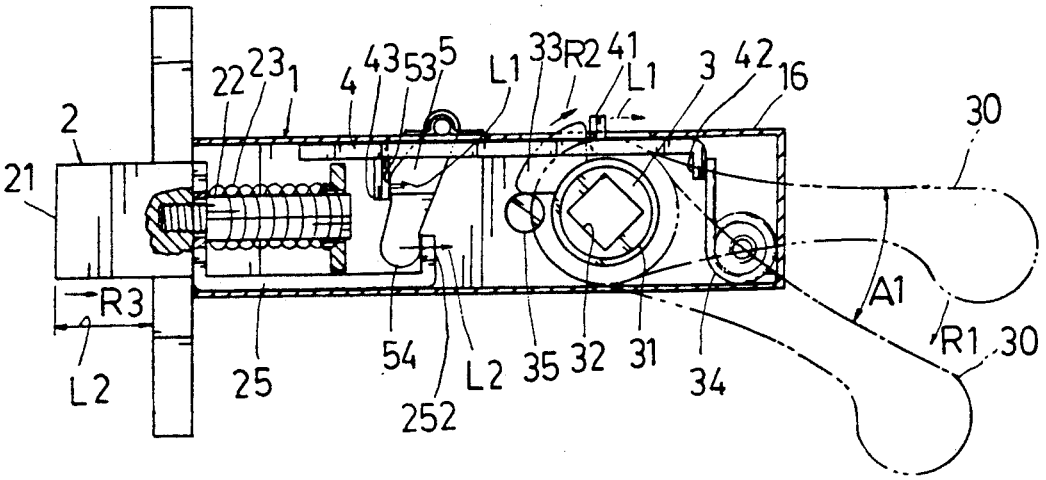
FIG. 6 shows an application in operating the present invention.

The handle driving means 3 includes a shaft 31 rotatably mounted on the housing 1, a square hole 32 formed in the shaft 31 to be fixed with a handle 30 as shown in FIG. 6, a cam portion 33 circumferentially formed on the shaft 31 generally shaped as a sector as shown in the figures in opposite to the handle 30, a handle restoring spring 34 formed in a rear portion of the housing 1 for normally levelling the door handle 30, and a stopper stem 35 formed in the housing 1 for limiting a restoring rotation movement of cam portion 33 when releasing a depression of the door handle 30.

The drag slide 4 generally formed as an elongate plate slidably held between the retainer plate 24, the shaft 31 and an upper portion 16 of the housing 1; and includes: a rear lug 41 protruding upwardly from the slide 4 to be operatively pulled by the cam portion 33 of the handle driving means 3, a rearmost bending portion 42 formed on a rearmost end portion of the slide to be actuated by the restoring spring 34, a front lug 43 protruding downwardly from the slide 4 to operatively bias the lever 5, and a longitudinal slot 44 formed in the slide between the two lugs 41, 43. The two lugs 41, 43 may be formed in situ by stamping the slide 4 to form the slot 44 and the lugs.

The biasing lever 5 includes: a pivot 51 pivotally secured on the housing 1 by at least a bracket 52 fixed on an upper portion 16 of the housing 1, an upper depression portion 53 generally formed as an arcuate portion formed on a middle portion of the lever 5 operatively depressible by the lug 43, and a lower forcing portion 54 generally formed as a round or arcuate shape formed on a lower portion of the lever 5 below the depression portion 53 operatively pulling the rear bending portion 252 of the follower plate 25 of the latch 2.

The rear slot 13 in the housing 1 is adapted for the sliding movement of the lug 41 and the front slot 4 is adapted for the pivoting operation of the lever 5.

Figure 7:
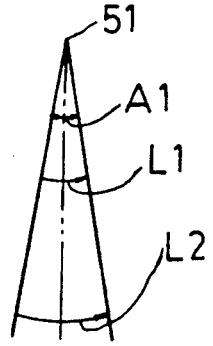
FIG. 7 shows an operation principle of the biasing lever of the present invention.
Figure 8:
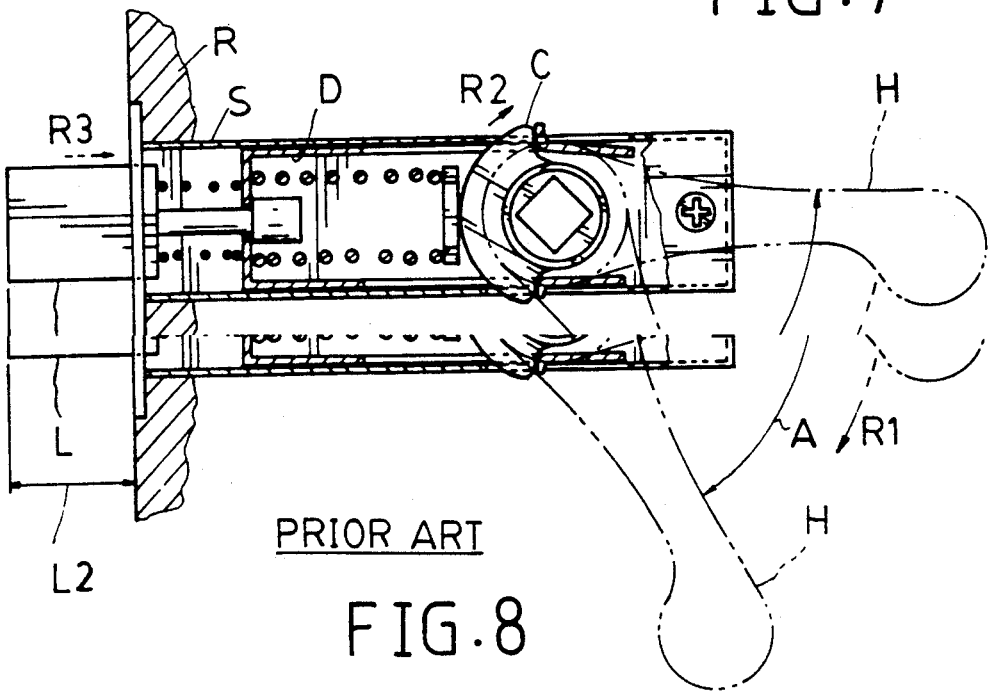
PRIOR ART FIG. 8
FIG. 8 shows a prior art of a conventional tubular latch.

When opening the door by depressing the handle 30 to rotate at an angle A1 as shown in FIG. 6, the cam portion 33 of the handle driving means 3 will be biased in direction R2 to pull the rear lug 41 rearwardly to move the slide 4 a distance or stroke L1, and the front lug 43 of the slide 4 will urge the depression portion 53 of lever 5 rearwardly for an arc length L1 as shown in FIG. 7 to allow the lower forcing portion 54 to push the rear bending portion 252 to follower plate 25 rearwardly for an arc length L2 which is generally equal to a stroke L2 for retracting the latch member 21 for opening the door. Since the first stroke L1 is smaller than the second stroke L2 so that a small angle A1 for rotating the handle 30 for opening the door can be effected in this invention, to be superior to a conventional tubular latch as shown in FIG. 8 of which the conventional latch requires a greater angle A (A>A1) for rotating the conventional handle H for opening the door provided with the conventional latch L.

Figure 9:
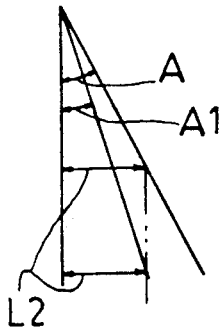
FIG. 9 shows a comparison of this application with the conventional latch.

As shown in FIG. 9, it is clearly illustrative that the biasing angle A1 of this application (about 30 degrees) is much small than the angle A (about 70 degrees) of the conventional latch, but having an equal stroke L2 for retracting the latch 21, L for opening the door. Accordingly, this application is more convenient for opening the door, especially helpful for those passers-by carrying a heavy goods by two hands or by a disabled person.

I claim:

1. A tubular latch comprising:

a housing combined by two half covers for integrally forming the housing fixed in a hole of a door, having a front fixing plate fromed on a front portion of the housing for fixing the housing on a door;

a latch means including a latch member reciprocatively held in said front fixing plate of said housing, a latch bolt secured with said latch member having a latch restoring spring disposed around said latch bolt for normally urging said latch member outwardly or frontwardly for locking purpose, a retainer plate fixed on said housing for retaining said latch restoring spring, and a follower plate having a front bending portion secured between the latch member and the latch bolt and a rear bending portion bending upwardly, said follower plate slidably held between said retainer plate and a bottom portion of said housing;

a handle driving means including a shaft rotatably mounted in a rear portion of said housing for securing a handle on said shaft, a cam portion circumferentially formed on said shaft in opposite to said handle, and a handle restoring spring resiliently restoring said handle driving means for normally levelling said handle;

a drag slide generally formed as an elongate plate slidably held in between said retainer plate, said shaft and an upper portion of said housing, having a rear lug protruding upwardly from a rear portion of said enlongated plate to be operatively pushed by said cam poriton, a rearmost bending portion formed on a rearmost end portion of said slide operatively actuated by said handle restoring spring, a front lug protruding downwardly from a front portion of said elongate slide, and a longitudinal slot formed in said slide between two said lugs; and a biasing lever pivotally secured in said housing having an upper depression portion formed on a middle portion of said lever operatively depressed by said front lug, and a lower forcing portion formed on a lower portion of said lever below said depression portion operatively depressing said rear bending portion of said follower plate, whereby upon a depression of said handle to rotate at a small angle, said cam portion of said handle driving means will be rotated to urge said rear lug of said slide rearwardly to allow said front lug of said slide to depress said upper depression portion of said lever, thereby allowing said lower forcing portion of said lever to force said rear bending portion of said follower plate rearwardly to retract said latch member for opening the door.

2. A tubular latch according to claim 1, wherein said handle driving means includes a stopper stem formed in said housing for limiting said cam portion when restored by said handle restoring spring.

3. A tubular latch according to claim 1, wherein said baising lever includes a pivot pivotally secured in a bracket fixed on an upper portion of said housing.

4. A tubular latch according to claim 1, wherein said latch bolt includes a male-threaded portion formed on its front portion engageable with a female-threaded hole formed in said latch member for securing said latch bolt with said latch member, said latch bolt having its rear end portion reciprocatively held in a central hole formed in said retainer plate.

5. A tubular latch according to claim 1, wherein said biasing lever includes said upper depression portion generally formed as an arcuate portion, and said lower forcing portion generally formed as a round or arcuate portion.

* * * * *